US010636638B2

(12) United States Patent
Sakuta et al.

(10) Patent No.: US 10,636,638 B2
(45) Date of Patent: Apr. 28, 2020

(54) MASS ANALYSIS APPARATUS AND METHOD

(71) Applicant: HITACHI HIGH-TECH SCIENCE CORPORATION, Tokyo (JP)

(72) Inventors: Masahiro Sakuta, Tokyo (JP); Shin Okawa, Tokyo (JP); Yoshiki Matoba, Tokyo (JP)

(73) Assignee: HITATCHI HIGH-TECH SCIENCE CORPORATION, Tokyo (JP)

( * ) Notice: Subject to any disclaimer, the term of this patent is extended or adjusted under 35 U.S.C. 154(b) by 0 days.

(21) Appl. No.: 16/041,679

(22) Filed: Jul. 20, 2018

(65) Prior Publication Data

US 2019/0027349 A1 Jan. 24, 2019

(51) Int. Cl.

*H01J 49/10* (2006.01)
*H01J 49/42* (2006.01)
*H01J 49/00* (2006.01)

(52) U.S. Cl.

CPC ..... *H01J 49/0036* (2013.01); *H01J 49/10* (2013.01); *H01J 49/4215* (2013.01)

(58) Field of Classification Search

CPC .... H01J 49/0036; H01J 49/0031; H01J 27/02; H01J 49/0009; H01J 49/0027; G01N 30/72; G01N 30/86; G01N 30/8644; G01N 30/8675

USPC ..... 250/282, 287, 252.1, 281, 288

See application file for complete search history.

(56) References Cited

U.S. PATENT DOCUMENTS 3,154,747 A * 10/1964 Kendall ..... G01J 3/28 250/281
2003/0042414 A1* 3/2003 Smith ..... H01J 49/0009 250/282
2007/0176088 A1* 8/2007 Li ..... G01N 27/62 250/282
2009/0321628 A1* 12/2009 Bateman ..... H01J 49/0036 250/282
2010/0001180 A1* 1/2010 Bateman ..... H01J 49/0036 250/282
2010/0012853 A1* 1/2010 Parks ..... G01J 3/4406 250/459.1

(Continued)

FOREIGN PATENT DOCUMENTS

JP 2001324476 A 11/2001
JP 2002005890 A 1/2002
JP 2004361367 A 12/2004

*Primary Examiner* — David A Vanore
(74) *Attorney, Agent, or Firm* — Holland & Hart LLP

(57) ABSTRACT

Disclosed is a mass analysis apparatus and method, wherein the precision of detection of a first material including a second material is improved, without enlarging the apparatus, and the measurement time is reduced. The mass analysis apparatus for analyzing a sample containing a first material including an organic compound and at least one second material including an organic compound and having a mass spectrum peak overlapping that of the first material includes a peak correction unit, wherein, when an intensity ratio (peak B)/(peak A) of peak A, not overlapping that of the first material, and peak B, overlapping that of the first material, is a correction coefficient (W), an intensity of a net peak D of the mass spectrum of the first material is calculated by subtracting W×(intensity of peak A) from an intensity of a peak C of the mass spectrum of the first material in the sample.

1 Claim, 8 Drawing Sheets

(56) References Cited

U.S. PATENT DOCUMENTS

| | | | | |
|---|---|---|---|---|
| 2011/0210242 | A1* | 9/2011 | Bateman | H01J 27/02 250/282 |
| 2012/0126110 | A1* | 5/2012 | Green | G06K 9/0053 250/282 |
| 2013/0181769 | A1* | 7/2013 | Noda | H03H 17/0294 327/551 |
| 2014/0252218 | A1* | 9/2014 | Wright | H01J 49/0036 250/282 |
| 2015/0340216 | A1* | 11/2015 | Kwiecien | G06K 9/00543 250/282 |
| 2019/0025123 | A1* | 1/2019 | Sakuta | H01J 49/0036 |
| 2019/0025174 | A1* | 1/2019 | Sakuta | G01N 33/0049 |

* cited by examiner

MASS ANALYSIS APPARATUS AND METHOD

CROSS REFERENCE TO RELATED APPLICATION

This application claims priority to and the benefit of Japanese Patent Application No. JP 2017-142234, by SAKUTA et al., filed Jul. 21, 2017, which is hereby incorporated by reference in its entirety into this application.

BACKGROUND OF THE INVENTION

1. Technical Field

The present invention relates to a mass analysis apparatus and method.

2. Description of the Related Art

In order to ensure the flexibility of a resin, the resin may contain, as a plasticizer, phthalate esters (commonly known as phthalates), but the use of four kinds of phthalates will be restricted starting in 2019 under the Restriction of Hazardous Substances (RoHS) adopted by the European Union. Hence, phthalates in resin are required to be identified and quantified.

Phthalates, which are volatile, may be analyzed through conventionally known EGA (Evolved Gas Analysis). EGA is used to analyze a gas component, evolved by heating a sample, using any type of analysis apparatus, such as a gas chromatograph or a mass spectrometer.

A mass analysis apparatus is known, and for example, a technique for performing correction calculation in order to measure an isotope ratio has also been disclosed (Patent Document 1).

CITATION LIST

Patent Literature (Patent Document 1) Japanese Patent No. 4256208

SUMMARY OF THE INVENTION

In order to quantify each of DBP, BBP and DEHP, which are regulation targets, from a sample containing phthalates, for example, DBP, BBP, DEHP and DOTP, mass analysis is typically performed because DBP, BBP, DEHP and DOTP have different molecular weights.

However, upon DBP quantification, for example, when a gas component evolved from a sample is ionized in a mass analysis apparatus, fragment ions are generated from BBP, DEHP, and DOTP, aside from DBP, and the mass spectrum peaks thereof may overlap the mass spectrum peak of DBP. In this case, it is difficult to accurately quantify DBP.

Although DBP alone may be quantified by disposing a gas chromatograph upstream of a mass analysis apparatus to thus separate the fragment ions, the overall size of the apparatus increases due to the use of the gas chromatograph, and moreover the measurement time increases.

Accordingly, the present invention has been made keeping in mind the problems encountered in the related art, and the present invention is intended to provide a mass analysis apparatus and method, in which the precision of detection of a first material including a second material such as an impurity may be improved, without the need to enlarge the apparatus, and moreover, the measurement time may be shortened.

Therefore, the present invention provides a mass analysis apparatus for analyzing a sample containing a first material comprising an organic compound and at least one second material comprising an organic compound and having a mass spectrum peak overlapping the mass spectrum peak of the first material, the mass analysis apparatus comprising: a peak correction unit, configured such that, when an intensity ratio (peak B)/(peak A) of peak A, which does not overlap the mass spectrum peak of the first material, and peak B, which overlaps the mass spectrum peak of the first material, among mass spectrum peaks of standard materials for the at least one second material, is a correction coefficient W, an intensity of a net peak D of the mass spectrum of the first material is calculated by subtracting W×(intensity of peak A) from the intensity of peak C of the mass spectrum of the first material in the sample.

In the mass analysis apparatus of the present invention, the intensity of the net peak D of the mass spectrum of the first material may be determined with high precision by subtracting the effect of the second material, the mass spectrum peak of which overlaps that of the first material, based on the intensity of peak A, which does not overlap the mass spectrum peak of the first material among the peaks of the second material.

Here, for example, the apparatus is not enlarged and the measurement time may be reduced, compared to when the effect of the second material is excluded by separating the first material and the second material using a chromatograph.

In the mass analysis apparatus of the present invention, two or more second materials are present, and the peak correction unit may subtract a sum of W×(intensity of peak A) values for the second materials from the intensity of the peak C.

In the mass analysis apparatus of the present invention, even when two or more second materials are present, the effects thereof may be subtracted with high precision.

In the mass analysis apparatus of the present invention, the peak correction unit may calculate the intensity of the peak D when W×(intensity of peak A) exceeds a predetermined threshold value.

In the mass analysis apparatus of the present invention, when the detected peak A is equal to or less than the threshold value, which is set as the estimated intensity of noise, noise is considered to be detected, and the intensity of peak D is not calculated, thereby preventing the inaccurate correction of peak D.

The mass analysis apparatus of the present invention may further comprise an ion source for ionizing the first material and the second material, the peak B being based on fragment ions generated from the second material upon ionization.

When the second material is ionized, it is easy to generate peak B, which overlaps the mass spectrum peak of the first material, and thus the present invention may be more effectively applied.

In addition, the present invention provides a mass analysis method for analyzing a sample containing a first material comprising an organic compound and at least one second material comprising an organic compound and having a mass spectrum peak overlapping the mass spectrum peak of the first material, the mass analysis method comprising: when an intensity ratio (peak B)/(peak A) of peak A, which does not overlap the mass spectrum peak of the first material, and peak B, which overlaps the mass spectrum peak of the first material, among mass spectrum peaks of standard materials for the at least one second material, is a correction coefficient W, calculating an intensity of a net peak D of the mass spectrum of the first material by subtracting W×(intensity of peak A) from the intensity of peak C of the mass spectrum of the first material in the sample.

According to the present invention, the precision of detection of mass analysis of a first material including a second material such as an impurity can be improved, without the need to enlarge the apparatus, and moreover, the measurement time can be reduced.

DESCRIPTION OF SPECIFIC EMBODIMENTS

Figure 1:
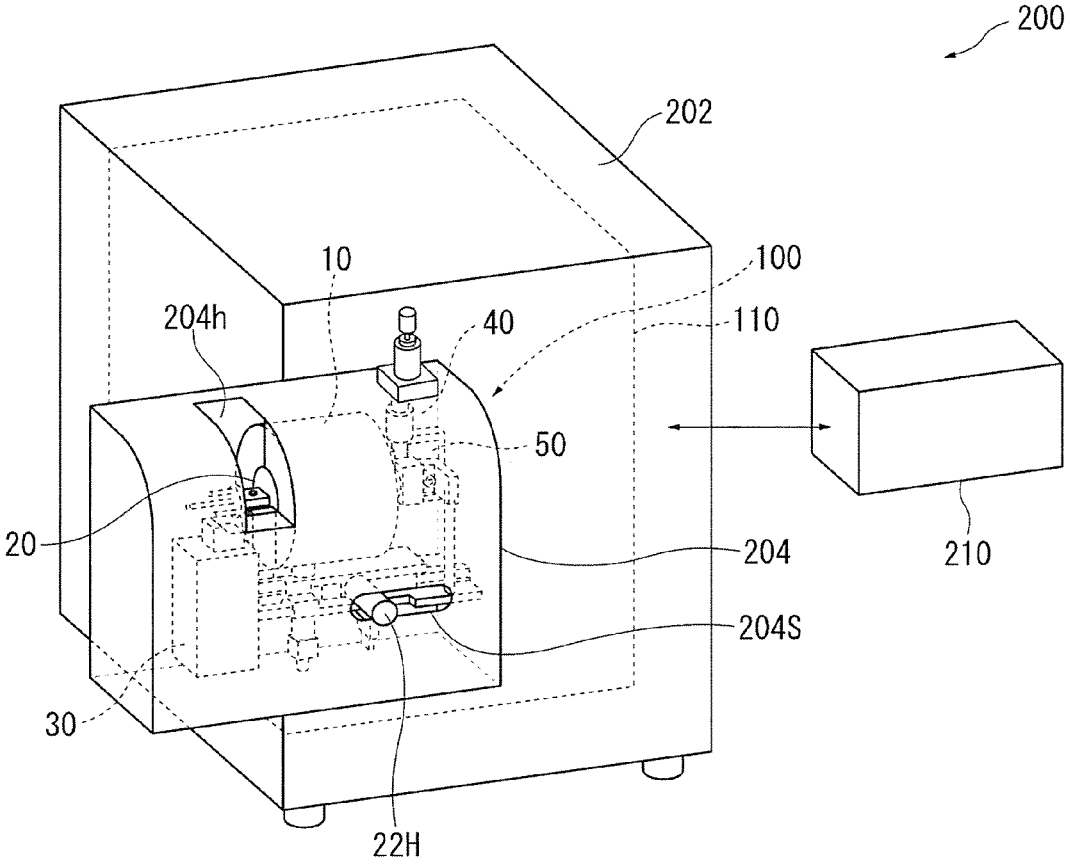
FIG. 1 is a perspective view showing the configuration of an apparatus for analyzing an evolved gas including a mass analysis apparatus according to an embodiment of the present invention.
Figure 2:
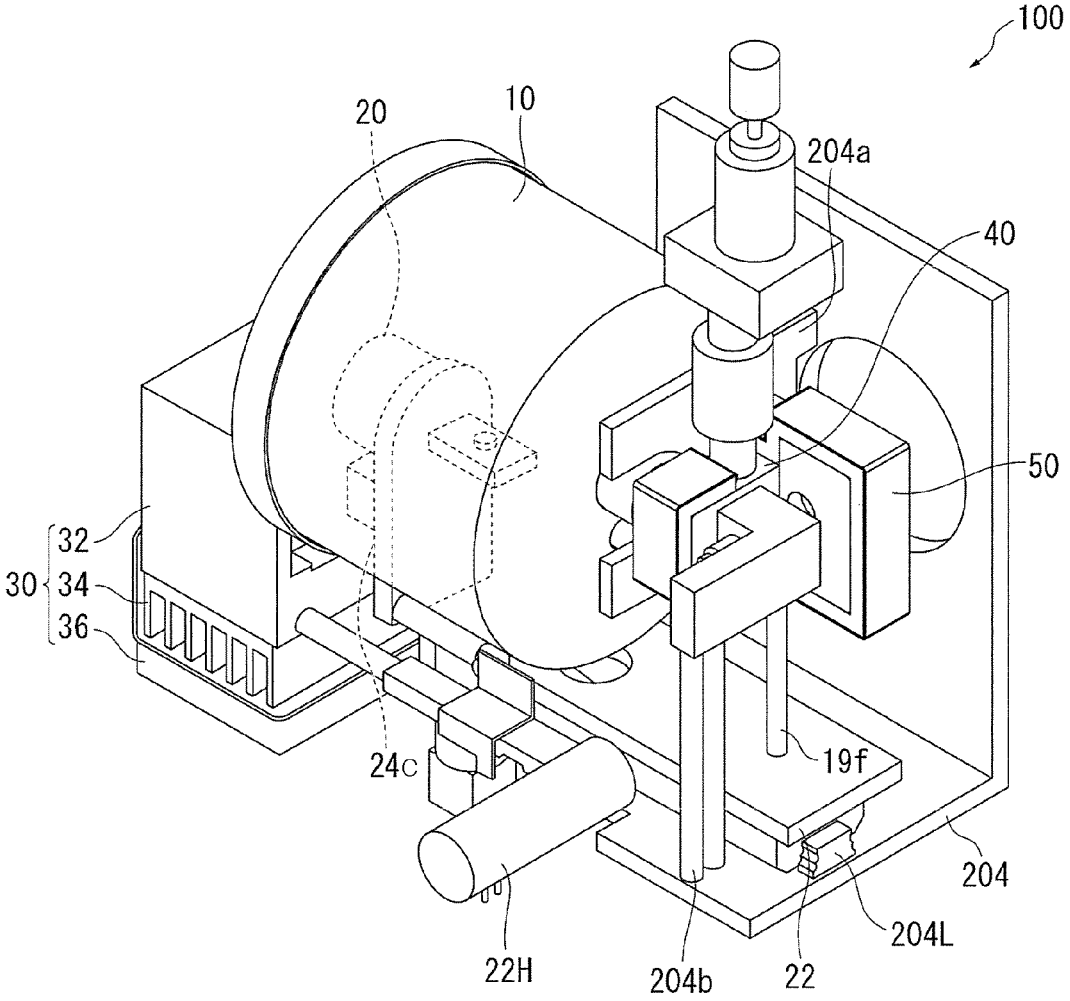
FIG. 2 is a perspective view showing the configuration of a gas evolving unit.
Figure 3:
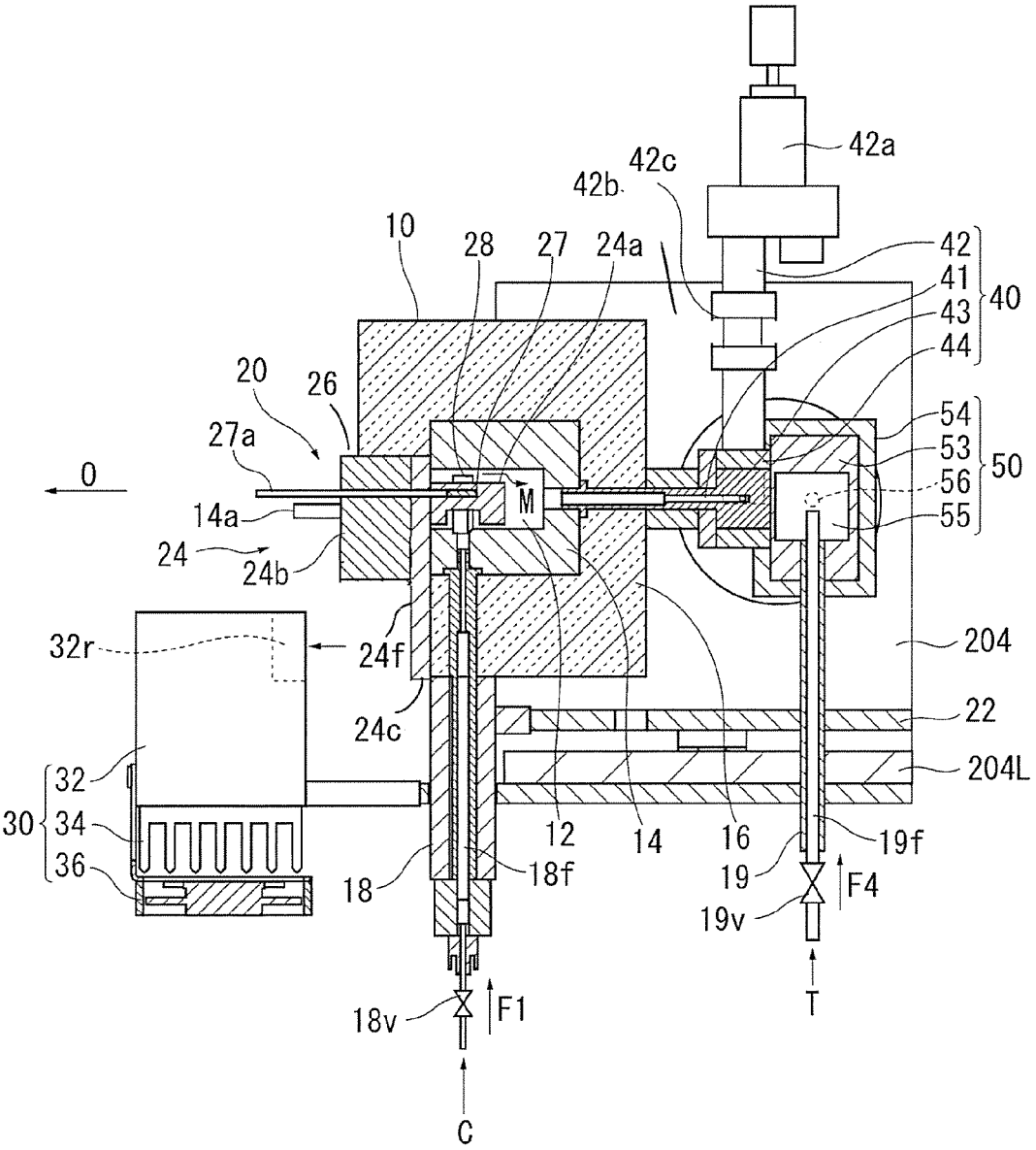
FIG. 3 is a longitudinal cross-sectional view showing the configuration of the gas evolving unit.
Figure 4:
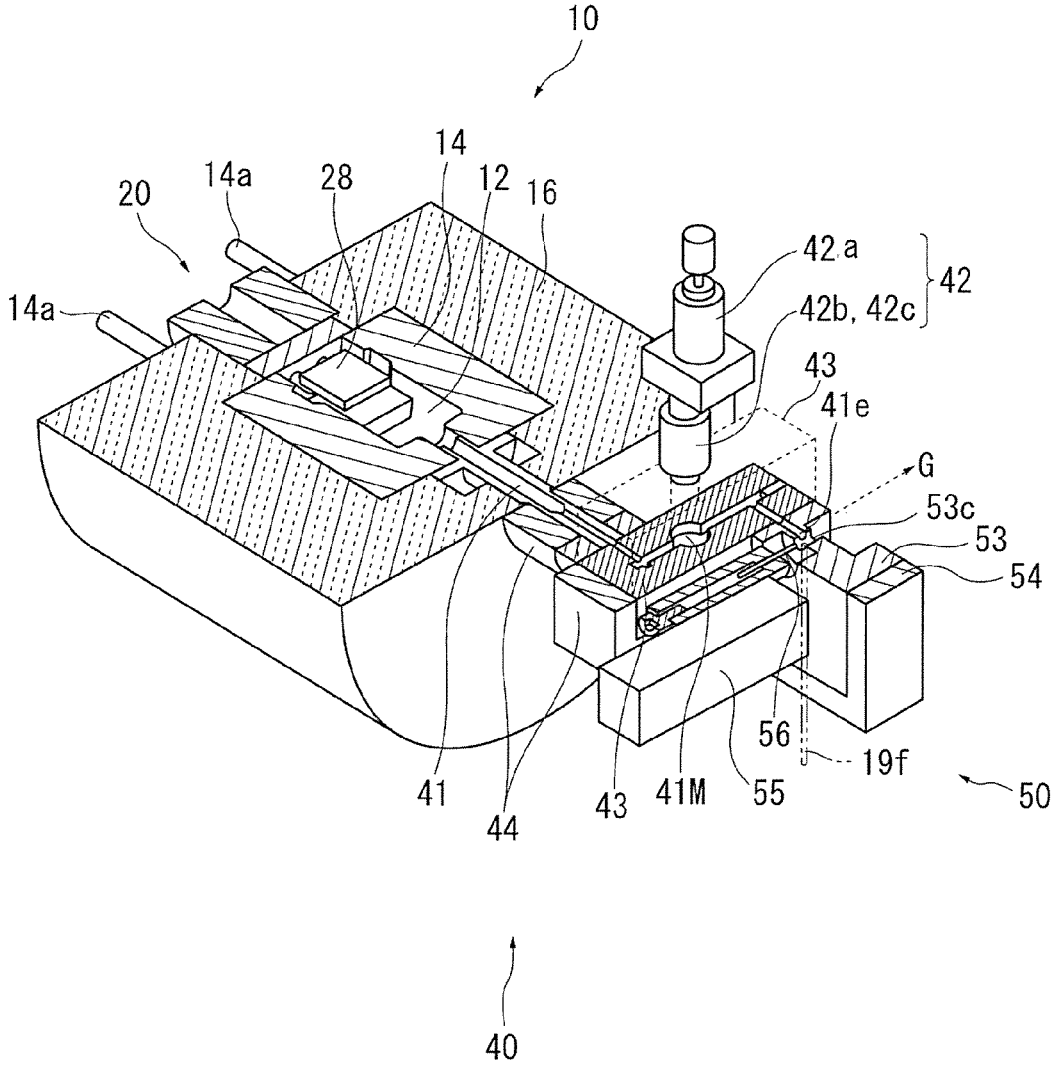
FIG. 4 is a transverse cross-sectional view showing the configuration of the gas evolving unit.
Figure 5:
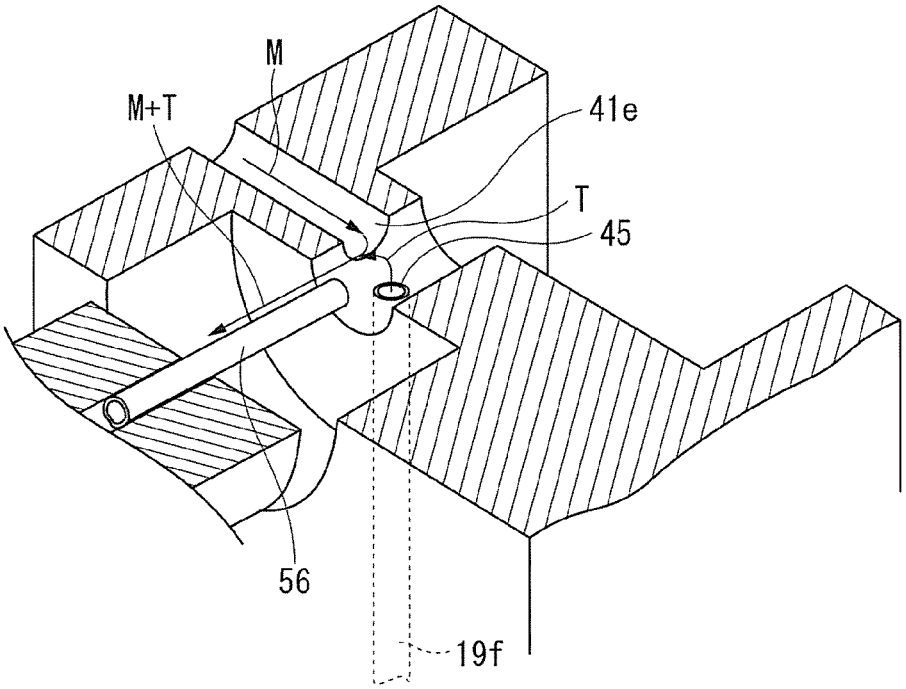
FIG. 5 is a partially enlarged view of FIG. 4.

Hereinafter, a detailed description will be given of embodiments of the present invention with reference to the appended drawings. FIG. 1 is a perspective view showing the configuration of an apparatus 200 for analyzing an evolved gas including a mass spectrometer (a mass analysis apparatus) 110 according to an embodiment of the present invention, FIG. 2 is a perspective view showing the configuration of a gas evolving unit 100, FIG. 3 is a longitudinal cross-sectional view showing the configuration of the gas evolving unit 100 on an axis O, FIG. 4 is a transverse cross-sectional view showing the configuration of the gas evolving unit 100 on the axis O, and FIG. 5 is a partially enlarged view of FIG. 4.

The apparatus 200 for analyzing an evolved gas includes a body unit 202, which is a housing, a box-shaped gas-evolving-unit attachment unit 204 attached to the front of the body unit 202, and a computer (control unit) 210 for controlling the entire apparatus. The computer 210 includes a CPU for data processing, a memory unit 218 for storing a computer program or data, a monitor 220, and input units such as a keyboard, etc.

The gas-evolving-unit attachment unit 204 accommodates therein a gas evolving unit 100 configured such that a cylindrical heating furnace 10, a sample holder 20, a cooler 30, a splitter 40 for gas splitting, an ion source 50, and an inert gas channel 19*f* are assembled together. Also, the body unit 202 accommodates therein a mass spectrometer 110 for analyzing a gas component evolved by heating a sample.

The ion source 50 is referred to as an ⌈ion source⌋ in the claims.

As shown in FIG. 1, an opening 204*h* is formed in the forward direction from the upper surface of the gas-evolving-unit attachment unit 204, and when the sample holder 20 is moved to the discharge position (which will be described later) outside the heating furnace 10, it is located at the opening 204*h*, whereby the sample may be placed in or taken out of the sample holder 20 via the opening 204*h*. Furthermore, a slit 204*s* is formed in the front of the gas-evolving-unit attachment unit 204, and the sample holder 20 is moved into or out of the heating furnace 10 by moving an opening/closing handle 22H exposed to the outside through the slit 204*s* in opposite directions, and is thus set to the above discharge position, whereby the sample may be placed in or taken out of the sample holder.

Also, for example, when the sample holder 20 is moved on a movement rail 204L (which will be described later) by means of a stepping motor, etc. controlled by the computer 210, the sample holder 20 may be automatically moved into or out of the heating furnace 10.

With reference to FIGS. 2 to 6, the configuration of the gas evolving unit 100 is described in detail below.

The heating furnace 10 is attached to the attachment plate 204*a* of the gas-evolving-unit attachment unit 204 in the state in which it is parallel to the axis O, and includes a heating chamber 12 having a substantially cylindrical shape, which is open on the axis O, a heating block 14, and a heat retaining jacket 16.

The heating block 14 is disposed on the outer surface of the heating chamber 12, and the heat retaining jacket 16 is disposed on the outer surface of the heating block 14. The heating block 14 is made of aluminum, and is heated through electrical conduction using a pair of heater electrodes 14*a* (FIG. 4) extending to the outside of the heating furnace 10 along the axis O.

Also, the attachment plate 204*a* extends in a direction perpendicular to the axis O, and the splitter 40 and the ion source 50 are attached to the heating furnace 10. Furthermore, the ion source 50 is supported by a support 2046 extending in the vertical direction of the gas-evolving-unit attachment unit 204.

The splitter 40 is connected to a position (at the right of FIG. 3) opposite the opening of the heating furnace 10. Also, a carrier gas protection pipe 18 is connected to the bottom of the heating furnace 10, and the carrier gas protection pipe 18 accommodates therein a carrier gas channel 18*f* that communicates with the lower surface of the heating chamber 12 to thus supply a carrier gas C to the heating chamber 12. The carrier gas channel 18*f* is provided with a control valve 18*v* for controlling the flow rate F1 of the carrier gas C.

Although the details thereof will be described later, a mixed gas channel 41 communicates with the end of the heating chamber 12 (at the right of FIG. 3) opposite the opening thereof, whereby a mixed gas M comprising the gas component G generated from the heating furnace 10 (heating chamber 12) and the carrier gas C is allowed to flow through the mixed gas channel 41.

Meanwhile, as shown in FIG. 3, an inert gas protection pipe 19 is connected to the bottom of the ion source 50, and the inert gas protection pipe 19 accommodates therein an inert gas channel 19*f* for supplying an inert gas T to the ion source 50. Furthermore, the inert gas channel 19*f* is provided with a control valve 19*v* for controlling the flow rate F4 of the inert gas T.

The sample holder 20 includes a stage 22 moving on the movement rail 204L attached to the inner upper surface of the gas-evolving-unit attachment unit 204, a bracket 24*c* attached onto the stage 22 and extending vertically, heat insulators 24*b*, 26 attached to the front of the bracket 24*c* (at the left of FIG. 3), a sample-holding unit 24*a* extending from the bracket 24*c* to the heating chamber 12 in the direction of the axis O, a heater 27 provided directly under the sample-holding unit 24*a*, and a sample plate 28 disposed at the upper surface of the sample-holding unit 24*a* directly above the heater 27 so as to receive the sample.

Here, the movement rail 204L extends in the direction of the axis O (the horizontal direction in FIG. 3), and the stage 22 of the sample holder 20 moves in the direction of the axis O. Furthermore, the opening/closing handle 2211 is attached to the stage 22 while extending in a direction perpendicular to the axis O.

Also, the bracket 24*c* has a long rectangular shape having a semicircular upper portion, and the heat insulator 24*b* has a substantially cylindrical shape and is attached to the front surface of the upper portion of the bracket 24*c* (FIG. 3), and the electrode 27*a* of the heater 27 protrudes outwards through the heat insulator 24*b*. The heat insulator 26 has a substantially rectangular shape, and is provided to the front surface of the bracket 24*c* at a position lower than the heat insulator 24*b*. The lower portion of the bracket 24*c* is not provided with the heat insulator 26, and the front surface of the bracket 24*c* is exposed to form a contact surface 24*f*.

The bracket 24*c* has a diameter slightly greater than that of the heating chamber 12 such that the heating chamber 12 is hermetically sealed, and the sample-holding unit 24*a* is accommodated in the heating chamber 12.

The sample placed on the sample plate 28 in the heating chamber 12 is heated in the heating furnace 10, thus generating the gas component G.

The cooler 30 is disposed to face the bracket 24*c* of the sample holder 20 and is located outside the heating furnace 10 (to the left of the heating furnace 10 in FIG. 3). The cooler 30 includes a cooling block 32 having a recessed portion 32*r* with a substantially rectangular shape, a cooling fin 34 connected to the lower surface of the cooling block 32, and a pneumatic cooling fan 36 connected to the lower surface of the cooling fin 34 so as to blow air to the cooling fin 34.

When the sample holder 20 moves toward the left of FIG. 3 in the direction of the axis O along the movement rail 204L and exits the heating furnace 10, the contact surface 24*f* of the bracket 24*c* comes into contact with the recessed portion 32*r* in the cooling block 32 while being accommodated in the recessed portion 32*r*, whereby heat is dissipated from the bracket 24*c* through the cooling block 32 to thus cool the sample holder 20 (in particular, the sample-holding unit 24*a*).

As shown in FIGS. 3 and 4, the splitter 40 includes the mixed gas channel 41 communicating with the heating chamber 12, a branch channel 42 open to the outside while communicating with the mixed gas channel 41, a back pressure controller 42*a* connected to the discharge side of the branch channel 42 and configured to adjust the back pressure at which the mixed gas M is discharged from the branch channel 42, a housing unit 43 in which the longitudinal end of the mixed gas channel 41 is open, and a heat retaining unit 44 surrounding the housing unit 43.

In the present embodiment, a filter 42*b* for removing impurities from the mixed gas and a flow meter 42*c* are interposed between the branch channel 42 and the back pressure controller 42*a*. Also, a pipe, which is not provided with a valve for adjusting back pressure, such as the back pressure controller 42*a*, and to which the end of the branch channel 42 is exposed, may be an example thereof.

As shown in FIG. 4, when viewed from above, the mixed gas channel 41 is provided in the shape of a crank in a manner that extends in the direction of the axis O while communicating with the heating chamber 12, is bent perpendicular to the direction of the axis O, and is also bent in the direction of the axis O to reach a longitudinal end part 41*e*. Furthermore, the center of the portion of the mixed gas channel 41 extending perpendicular to the direction of the axis O is enlarged in the diameter thereof to form a branch chamber 41M. The branch chamber 41M extends to the top of the housing unit 43, and the branch channel 42, having a diameter slightly smaller than that of the branch chamber 41M, is fitted thereto.

The mixed gas channel 41 may be provided in the form of a straight line that reaches the longitudinal end part 41*e* by extending in the direction of the axis O while communicating with the heating chamber 12, or may be provided in the form of any curved shape or a linear shape having an angle with respect to the axis O depending on the position of the heating chamber 12 or the ion source 50.

As shown in FIGS. 3 and 4, the ion source 50 includes an ionizer housing unit 53, an ionizer heat retaining unit 54 surrounding the ionizer housing unit 53, an electric discharge needle 56, and a staying unit 55 for fixing the electric discharge needle 56. The ionizer housing unit 53 has a plate shape, and the surface of the plate is parallel to the axis O, and a small hole 53*c* is formed in the center of the surface of the plate. The longitudinal end part 41*e* of the mixed gas channel 41 faces the side wall of the small hole 53*c* through the inside of the ionizer housing unit 53. The electric discharge needle 56 extends in a direction perpendicular to the axis O and thus faces the small hole 53*c*.

As shown in FIGS. 4 and 5, the inert gas channel 19*f* vertically penetrates the ionizer housing unit 53, and the tip of the inert gas channel 19*f* faces the bottom of the small hole 53*c* in the ionizer housing unit 53 and forms a junction 45 that joins the longitudinal end part 41*e* of the mixed gas channel 41.

The mixed gas M introduced to the junction 45 near the small hole 53*c* from the longitudinal end part 41*e* is mixed with the inert gas T from the inert gas channel 19*f* to thus form a combined gas M+T, which is then made to flow toward the electric discharge needle 56. Of the combined gas M+T, the gas component G is ionized by the electric discharge needle 56.

The ion source 50 is a known device, and in the present embodiment, an atmospheric pressure chemical ionization (APCI)-type ion source is adopted. APCI does not readily fragment the gas component G and does not generate fragment peaks, and is desirably used because a measurement target may be detected even without separation through chromatography.

The gas component G ionized by the ion source 50 is introduced together with the carrier gas C and the inert gas T into the mass spectrometer 110 and is thus analyzed.

The ion source 50 is accommodated in the ionizer heat retaining unit 54.

Figure 6:
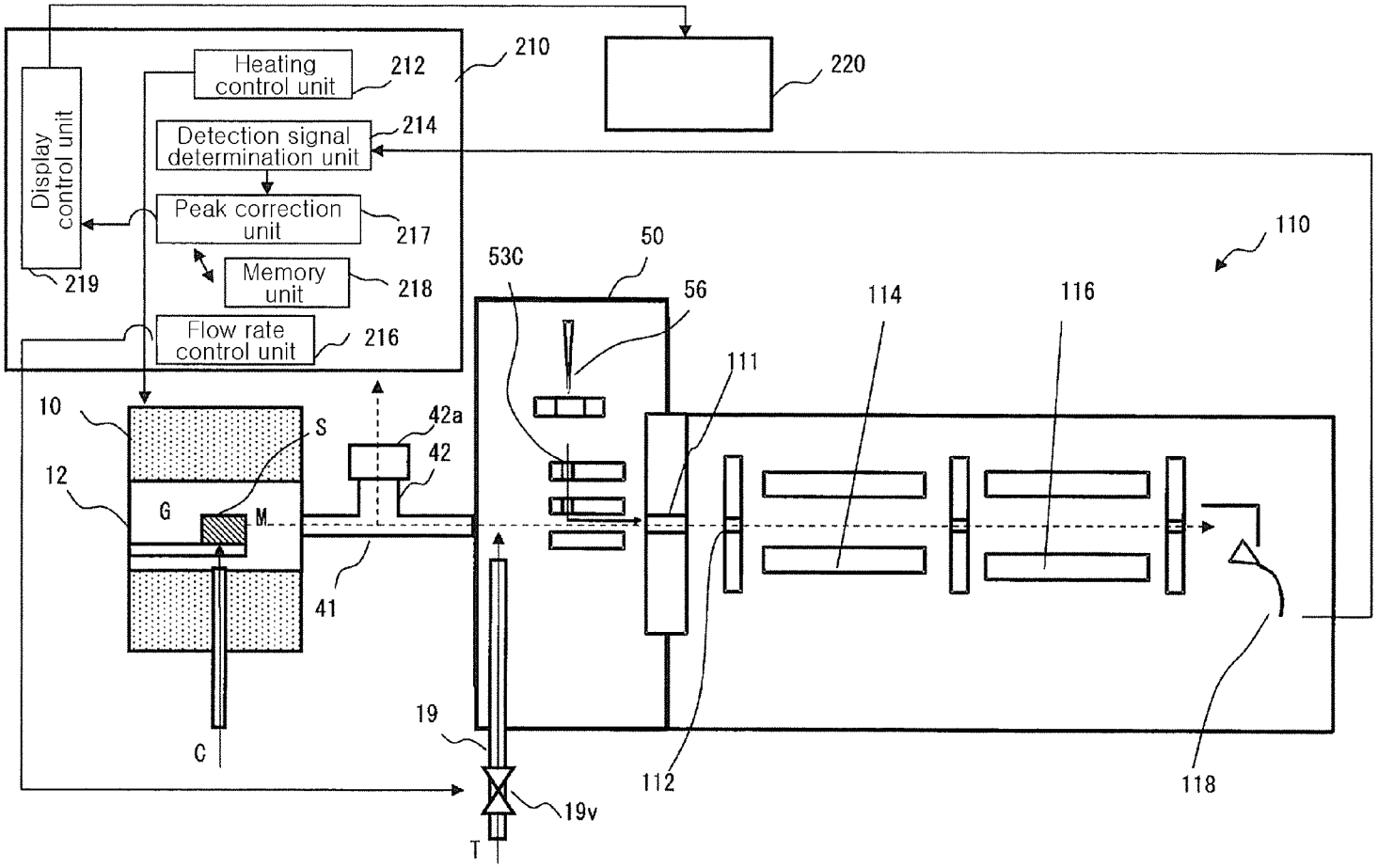
FIG. 6 is a block diagram showing a process of analyzing a gas component using the apparatus for analyzing an evolved gas.

FIG. 6 is a block diagram showing the process of analyzing the gas component using the apparatus 200 for analyzing an evolved gas.

A sample S is heated in the heating chamber 12 of a heating furnace 10, thus generating a gas component G. The heating state (heating rate, maximum temperature, etc.) of the heating furnace 10 is controlled by the heating control unit 212 of the computer 210.

The gas component G is mixed with the carrier gas C introduced into the heating chamber 12 to form a mixed gas M, which is then supplied to the splitter 40, and a portion of the mixed gas M is emitted outside from the branch channel 42.

To the ion source 50, the remainder of the mixed gas M and the inert gas T from the inert gas channel 19*f* are supplied as the combined gas M+T, and the gas component G is ionized therein.

The detection signal determination unit 214 of the computer 210 receives a detection signal from the detector 118 (which will be described later) of the mass spectrometer 110.

The flow rate control unit 216 determines whether the peak intensity of the detection signal received in the detection signal determination unit 214 falls outside of a threshold range. When the peak intensity is determined to fall outside of the threshold range, the flow rate control unit 216 controls the opening ratio of the control valve 19*v*, whereby the flow rate of the mixed gas M discharged outside from the branch channel 42 in the splitter 40, particularly the flow rate of the mixed gas M introduced to the ion source 50 from the mixed gas channel 41, is adjusted, thus maintaining the maximum precision of detection of the mass spectrometer 110.

The mass spectrometer 110 includes a first aperture 111, through which the gas component G ionized in the ion source 50 is introduced, a second aperture 112, through which the gas component G flows after flowing through the first aperture 111, an ion guide 114, a quadrupole mass filter 116, and a detector 118 for detecting the gas component G discharged from the quadrupole mass filter 116.

The quadrupole mass filter 116 varies an applied high frequency voltage to thus enable mass scanning, and generates a quadrupole electric field and thus detects ions by subjecting the ions to vibratory motion within the quadrupole electric field. The quadrupole mass filter 116 functions as a mass separator that transmits only the gas component G within a certain mass range such that the detector 118 may identify and quantify the gas component.

Also, in the present embodiment, the inert gas T is allowed to flow into the mixed gas channel 41 downstream of the branch channel 42, and thus flow resistance that suppresses the flow rate of the mixed gas M introduced into the mass spectrometer 110 may result, whereby the flow rate of the mixed gas M discharged from the branch channel 42 is adjusted. Specifically, as the flow rate of the inert gas T increases, the flow rate of the mixed gas M discharged from the branch channel 42 also increases.

Thereby, when the gas concentration becomes too high due to the gas component evolved in a large amount, the flow rate of the mixed gas discharged outside from the branch channel is increased, thereby preventing inaccurate measurement due to over-scale of the detection signal that exceeds the detection range of the detection member.

Figure 7:
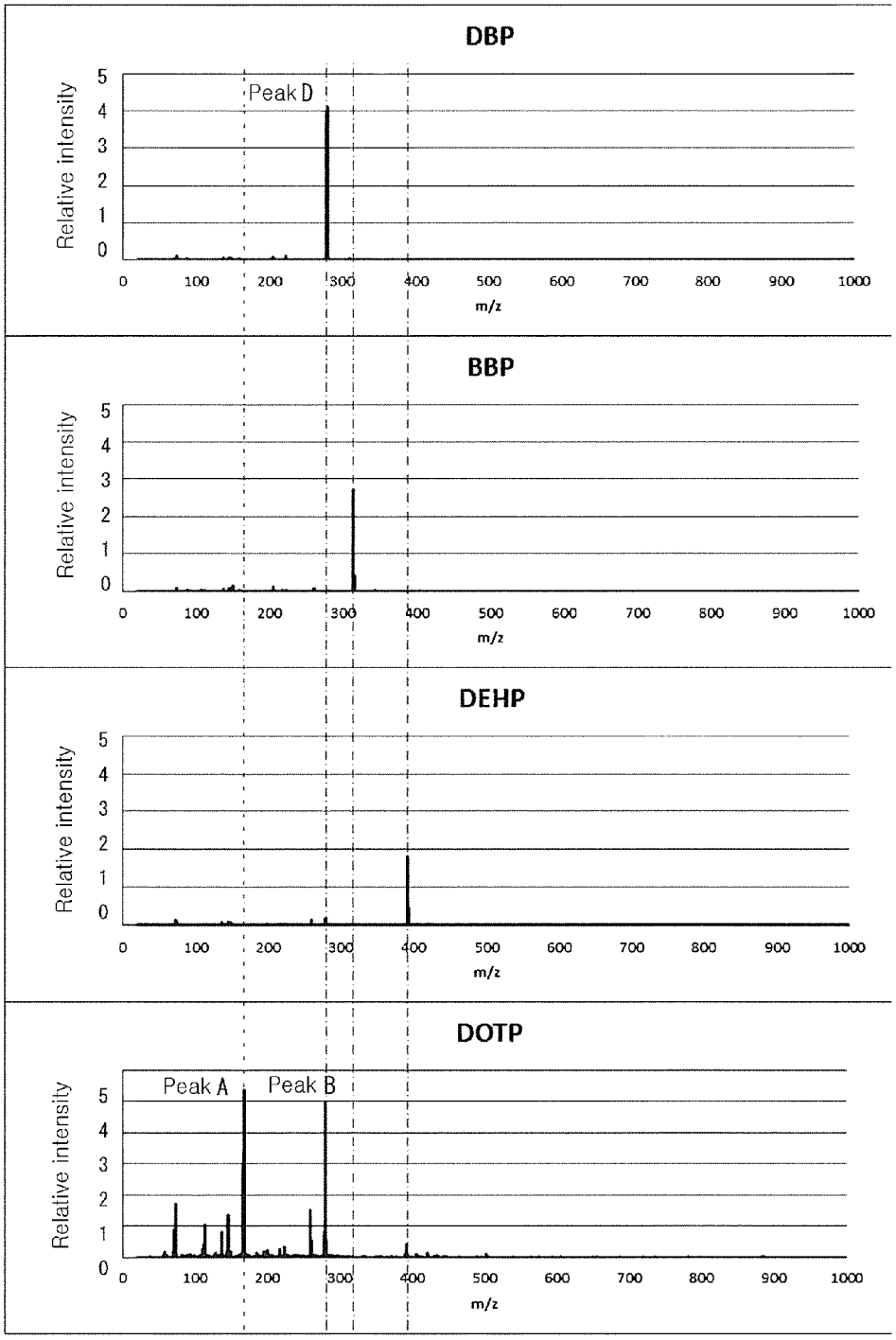
FIG. 7 shows the mass spectrum of the standard material of each of DBP, BBP, DEHP and DOTP.
Figure 8:
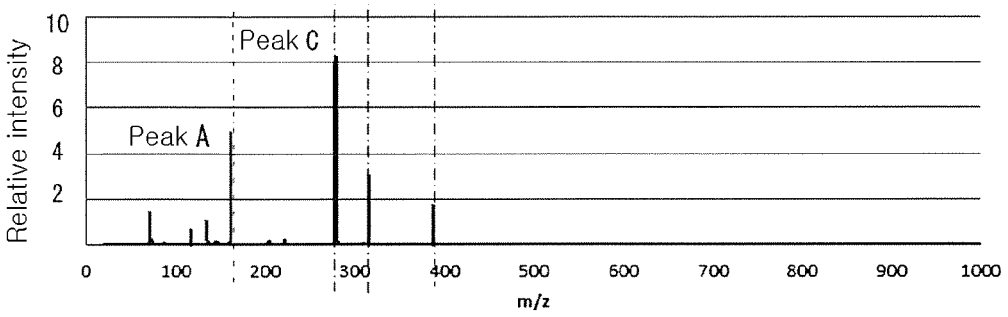
FIG. 8 shows the mass spectrum of a sample including DBP and DOTP.
Figure 9:
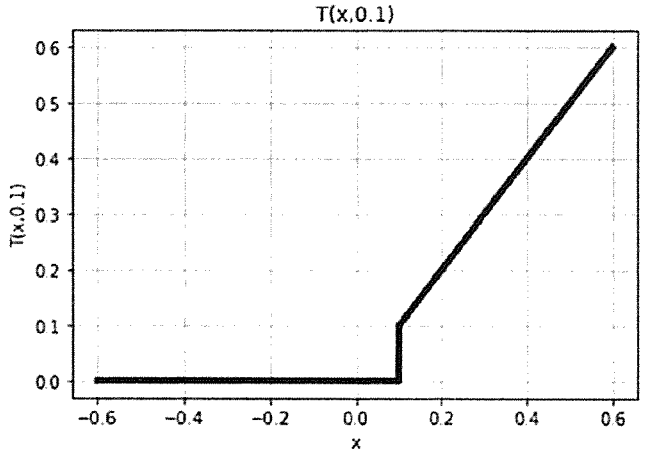
FIG. 9 shows the function T.

Next, with reference to FIGS. 7 to 9, the peak correction of the mass spectrum, which is characterized in the present invention, is described. Here, the sample is a vinyl chloride resin, in which phthalates, such as DBP, BBP, DEHP and DOTP, are contained as the plasticizer. DBP, which is a kind of phthalate and is thus a restricted material, is referred to as a ⌈first material⌋ in the claims, and the first material is a measurement target.

FIG. 7 shows the mass spectrum of the standard material of each of DBP, BBP, DEHP and DOTP. In FIGS. 7 and 8, the intensity in the longitudinal axis indicates the relative value.

As shown in FIG. 7, the mass spectrum of DBP has the peak (net peak D) at a mass-to-charge ratio (m/z) of about 280, and typically DBP may be quantified using the peak D. Furthermore, the mass spectrum peaks of BBP and DEHP have mass-to-charge ratios (m/z) different from that of the peak D of DBP and thus do not overlap the peak D of DBP, thus it does not disturb the quantification of DBP.

Meanwhile, DOTP produces fragment ions through cleavage upon ionization in the mass analysis apparatus, and as shown in FIG. 7, any one of the fragment ions is shown as the peak B that overlaps the peak D of DBP. Thus, DOTP is referred to as a ⌈second material⌋ in the claims, and the second material is an impurity.

In this way, since the peak D overlaps the peak B, when the mass spectrum of the sample containing DBP and DOTP, which are mixed together, is measured, as shown in FIG. 8, the intensity of the peak (hereinafter referred to as ⌈peak C⌋) of DBP at a mass-to-charge ratio (m/z) of about 280 is the sum of the intensities of peak B and peak D, and is higher than the intensity of the net peak D of DBP when the sample contains no DOTP.

Here, in the mass spectrum (of fragment ions) of DOTP, the peak A does not overlap the peak D. The ratio of fragment ions generated through cleavage of DOTP is considered to be maintained constant so long as the ionization conditions of the mass analysis apparatus are fixed. That is, the intensity ratio (peak B)/(peak A) is deemed to be constant.

Accordingly, the intensity ratio (peak B)/(peak A) is determined as the correction coefficient W, and as represented in Equation 1, when W×(intensity of peak A) is subtracted from the intensity of peak C, the intensity of net peak D may be calculated.

$$(\text{Intensity of peak } D) = (\text{intensity of peak } C) - W \times (\text{intensity of peak } A) \qquad \text{Equation 1:}$$

Also, in the case where two or more second materials are present in the sample, when the intensity of net peak D is calculated, the sum of W×(intensity of peak A) values for individual second materials is subtracted from the intensity of peak C.

When noise is falsely detected as peak A upon measurement, the correction itself becomes erroneous. Therefore, only in the case where W×(intensity of peak A) exceeds a predetermined threshold value (assuming that the background is noise), the intensity of peak D is corrected.

Equation 2 is the generalization of Equation 1.

[Mathematical Formula 1]

$$a_i' = a_i - \sum_{m=1}^{n} T(a_m w_{im}, g \cdot a_i) \qquad \text{Equation 2}$$

In Equation 2, $a_i$ or $a_m$ is the intensity (area) of the peak of the first material or second material, i and m are a natural number of 1 or more, and n is the total number (number of components) of the first material and the second material. In FIG. 7, each of the first material and the second material is 1, and thus n=2. In this case, i=m=1, that is, $a_1$ is the intensity of peak C of the first material before correction, and i=m=2, that is, $a_2$ is the intensity of peak A of only the second material before correction.

$W_{im}$ is the correction coefficient. Also, at i=m, the first material and the second material become identical to each other, and thus $W_{im}=0$, which is not included in the correction.

Also, g is the round-down coefficient, and in the present embodiment, g is set to 0.01. Furthermore, $g \cdot a_i$ is the threshold value assuming the intensity of noise.

T is the round-down function, and is represented in Equation 3 below.

[Mathematical Formula 2]

$$T(x, t) = \begin{cases} x & \text{if } t < x \\ 0 & \text{otherwise} \end{cases} \quad \text{Equation 3}$$

As shown in FIG. 9, T returns the numerical value x if the numerical value x ($a_m \times W_{im}$ in Equation 2) exceeds the threshold value t ($g \cdot a_i$ in Equation 2), and returns 0 if the numerical value is equal to or less than the threshold value t.

In the present embodiment, Equation 2 is expressed as the following two equations.

$$a_1' = a_1 - \{T(a_1 \times w_{1,1}, g \cdot a_1) + T(a_2 \times w_{1,2}, g \cdot a_1)\}$$

$$a_2' = a_2 - \{T(a_1 \times w_{2,1}, g \cdot a_2) + T(a_2 \times w_{2,2}, g \cdot a_2)\} \quad \text{[Mathematical Formula 3]}$$

Specifically, Equation 2 treats the first material (DBP) and the second material (DOTP) in a symmetric manner, varying depending on the values of i and m. Specifically, when it is desired to use the second material (DOTP) as the first material, simultaneous quantification of the second material (DOW) becomes possible based on Equation 2.

Thus, in Equation 2, when the first material and the second material are treated in a symmetric manner, for example, when the intensity ratio of the materials varies depending on the measurement conditions, the first material and the second material, which interact with each other, may be simultaneously measured, making it possible to obtain optimal measurement conditions.

Here, $W_{1,1}=W_{2,2}=0$, and the above two equations become as follows.

$$a_1' = a_1 - \{T(a_2 \times W_{1,2}, g \times a_1)\}$$

$$a_2' = a_2 - \{T(a_1 \times W_{2,1}, g \times a_2)\}$$

Now, attention is paid only to the former equation related to the first material. In addition, the latter equation is symmetrical with the former equation when the second material is used as a reference.

$$a_1' = a_1 - \{T(a_2 \times W_{1,2}, g \times a_1)\} \quad \text{Equation 4:}$$

Specifically, Equation 4 becomes the following Equation 5.

$$[\text{Intensity of peak } D] = [\text{intensity of peak } C] - T([\text{intensity of peak } A] \times W_{1,2}, g \times [\text{intensity of peak } C]) \quad \text{Equation 5:}$$

Here, $W_{1,2}$ is related to the intensity ratio (peak B)/(peak A). Also, for g×(intensity of peak C), at g=0.01, the intensity of peak C is 1%, and this value becomes the threshold value.

Accordingly, based on Equation 3, when T (round-down function) of Equation 5 is {(intensity of peak A)×$W_{1,2}$}>{threshold value g×(intensity of peak C)}, the value of (intensity of peak A)×$W_{1,2}$ is regarded as true, not noise, and thus the value of (intensity of peak A)×$W_{1,2}$ is output. On the other hand, when T is {(intensity of peak A)×$W_{1,2}$}<{threshold value g×(intensity of peak C)}, peak A is regarded as noise, and 0 is returned, and no correction is carried out.

In Equation 5, when T outputs the value of (intensity of peak A)×$W_{1,2}$, Equation 6 is obtained, and thus becomes equal to Equation 1.

$$(\text{Intensity of peak } D) = (\text{intensity of peak } C) - (\text{intensity of peak } A) \times W_{1,2} \quad \text{Equation 6:}$$

Next, with reference to FIG. 6, the aforementioned peak correction processing is described.

The correction coefficient $W_{i,m}$ is stored in the memory unit 218 of a hard disk for each of the first material and the second material. Specifically, for example, an operator specifies a first material and a second material through a keyboard or the like, and sets a sample containing the first material and the second material.

The detection signal determination unit 214 of the computer 210 acquires peaks (peak A and peak C in this example) of the mass spectrum depending on the first material and the second material.

The peak correction unit 217 of the computer 210 reads the correction coefficient $W_{i,m}$ related to the first material and the second material from the memory unit 218 and also acquires the peak A and the peak C from the detection signal determination unit 214, and the intensity of the net peak D is calculated as described above based on Equations 2 and 3. Equations 2 and 4 are stored in the memory unit 218 using a computer program.

When necessary, the peak correction unit 217 may display the peak D on the monitor 220 through the display control unit 219.

The present invention is not limited to the aforementioned embodiments, and it goes without saying that various modifications and equivalents are included in the spirit and scope of the present invention.

The first material and the second material are not limited to the above embodiments, and a plurality of second materials may be used.

The peak A and the peak B are not limited to one each. For example, when the second material has two peaks A and one peak B, the intensity ratio of any one peak A and peak B may be used as a correction coefficient. In another example, the intensity ratio of an average of two peaks A and peak B may be used as the correction coefficient.

On the other hand, when the second material has one peak A and two peaks B, the intensity ratio of peak A and any one peak B is determined as a first correction coefficient, and is used for the correction of the corresponding peak B. The intensity ratio of peak A and the remaining peak B is determined as a second correction coefficient, and is used for the correction of the corresponding remaining peak B.

The method of introducing the sample into the mass analysis apparatus is not limited to the method of evolving the gas component by thermally decomposing the sample in the heating furnace described above. For example, a solvent-extraction-type GC/MS or LC/MS may be used, in which solvent containing a gas component is introduced and thus the gas component is evolved while volatilizing the solvent.

The ion source 50 is not limited to the APCI type.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A mass analysis method for analyzing a sample containing a first material comprising an organic compound and at least one second material comprising an organic compound and having a mass spectrum peak overlapping a mass spectrum peak of the first material, the mass analysis method comprising:

ionizing, by an ion source, the first material and the second material, detecting, by a detector, a mass spectrum peak of a gas component which is ionized in the ion source, when an intensity ratio (peak B)/(peak A) of peak A, which does not overlap the mass spectrum peak of the first material, and peak B, which overlaps the mass spectrum peak of the first material, among mass spectrum peaks of standard materials for the at least one second material, is a correction coefficient (W), calculating, by a processor of a computer, an intensity of a net peak D of a mass spectrum of the first material by subtracting W×(intensity of peak A) from an intensity of a peak C of the mass spectrum of the first material in the sample.

* * * * *